US006041585A

United States Patent [19]

Mekata et al.

[11] Patent Number: 6,041,585

[45] Date of Patent: Mar. 28, 2000

[54] SPINNING MACHINE AND ITS OPERATION METHOD

[75] Inventors: Tsutomu Mekata, Otsu; Akio Matsushima, Kyoto, both of Japan

[73] Assignee: Murata Kikai Kabushiki Kaisha, Kyoto, Japan

[21] Appl. No.: 09/139,560

[22] Filed: Aug. 25, 1998

[30] Foreign Application Priority Data

Sep. 22, 1997 [JP] Japan ..... 9-275339

[51] Int. Cl.[7] ..... D01H 13/00

[52] U.S. Cl. ..... 57/97; 57/264; 57/104; 57/315; 57/328; 57/332; 57/335

[58] Field of Search ..... 57/264, 315, 328, 57/331, 332, 334, 335, 104, 97; 19/293, 260

[56] References Cited

U.S. PATENT DOCUMENTS

| | | | |
|---|---|---|---|
| 5,003,668 | 4/1991 | Meyer | 19/0.22 |
| 5,022,123 | 6/1991 | Ueda et al. | 19/293 |
| 5,090,192 | 2/1992 | Stahlecker | 57/328 |
| 5,099,640 | 3/1992 | Kobayashi et al. | 57/264 |
| 5,400,582 | 3/1995 | Hartmeier et al. | 57/264 |
| 5,535,481 | 7/1996 | Hartmeier et al. | 19/260 |
| 5,699,661 | 12/1997 | Maruki | 57/315 |

*Primary Examiner*—William Stryjewski
*Attorney, Agent, or Firm*—Armstrong, Westerman, Hattori, McLeland and Naughton

[57] ABSTRACT

To prevent yarn from being cut when an operating spinning machine stops, thereby preventing subsequent re-activation from being affected. In a spinning machine for manufacturing yarn by passing a fiber bundle that exits a draft apparatus 1 through a spinning nozzle 2 injecting a swirling air current and then through a twisting apparatus 3 that twists the fiber bundle in a direction reverse to that of the swirling air current, each spinning unit is driven independently, and the draft apparatus 1 can be decelerated or accelerated with the speed ratio of each pair of rollers being maintained. When the spinning is stopped or activated, the draft apparatus 1 and the twisting apparatus 3 simultaneously decelerate or accelerate so as to be simultaneously stopped or activated, and in response to this operation, air injection from the spinning nozzle 2 stops or starts.

7 Claims, 3 Drawing Sheets

SPINNING MACHINE AND ITS OPERATION METHOD

FIELD OF THE INVENTION

The present invention relates to a method for operating and stopping a spinning machine, particularly a spinning machine having a spinning nozzle.

BACKGROUND OF THE INVENTION

The following spinning machine having a spinning nozzle is conventionally used. In this spinning machine, a sliver is drafted by a draft apparatus and twisted by a swirling current of compressed air from a spinning nozzle. A twisting apparatus located immediately after the spinning nozzle then twists the sliver in a direction reverse to that of the twisting by the spinning nozzle to manufacture a spun yarn.

When the spinning of a spinning unit of the spinning machine stops, the third and the back rollers of the draft apparatus in the spinning unit stop, and the twisting apparatus stops after the front and the second rollers have fed out a fiber bundle. The spinning nozzle, however, continues operating and the winding section stops after winding of the yarn is finished. Thus, when the spinning stops, the end of the spun yarn from the spinning unit is inevitably cut before the spinning nozzle, so the yarn must be pieced each time the spinning is re-activated even in the case of a short stoppage time.

It is an object of the present invention to prevent yarn from being cut when the operating spinning machine stops so that subsequent activation will not be affected.

SUMMARY OF THE INVENTION

According to a spinning machine operation method used for the present invention, in a spinning machine for manufacturing yarn by passing a fiber bundle that exits a draft apparatus 1 through a spinning nozzle 2, injecting a swirling air current, and then passing the fiber fondle through a twisting apparatus 3 that twists the fiber bundle in a direction reverse to that of the swirling air current, each spinning unit is driven independently, and the draft apparatus 1 can be decelerated or accelerated with the speed ratio of each pair of rollers being maintained. When the spinning is stopped or activated, the draft apparatus 1 and the twisting apparatus 3 simultaneously decelerate or accelerate so as to be simultaneously stopped or activated, and in conjunction with this operation, air injection from the spinning nozzle 2 stops or starts.

Air injection from the spinning nozzle 2 stops later than the twisting apparatus 3 when the spinning stops, whereas it starts before the twisting apparatus 3 when the spinning is activated. Preferably, the deceleration rate prior to the stop of the spinning is small, whereas the acceleration rate during the activation of the spinning is large.

The present invention provides a spinning machine for manufacturing yarn by passing a fiber bundle that exits the draft apparatus 1 through a spinning nozzle 2 injecting a swirling air current and then through the twisting apparatus 3 that twists the fiber bundle in a direction reverse to that of the swirling air current, wherein the draft apparatus 1 and the twisting apparatus 3 are driven by one motor.

DETAILED DESCRIPTION OF THE PREFERRED EMBODIMENTS

Embodiments of a spinning machine and its operation method according to the present invention are described with reference to FIGS. 1 and 2.

Figure 1:
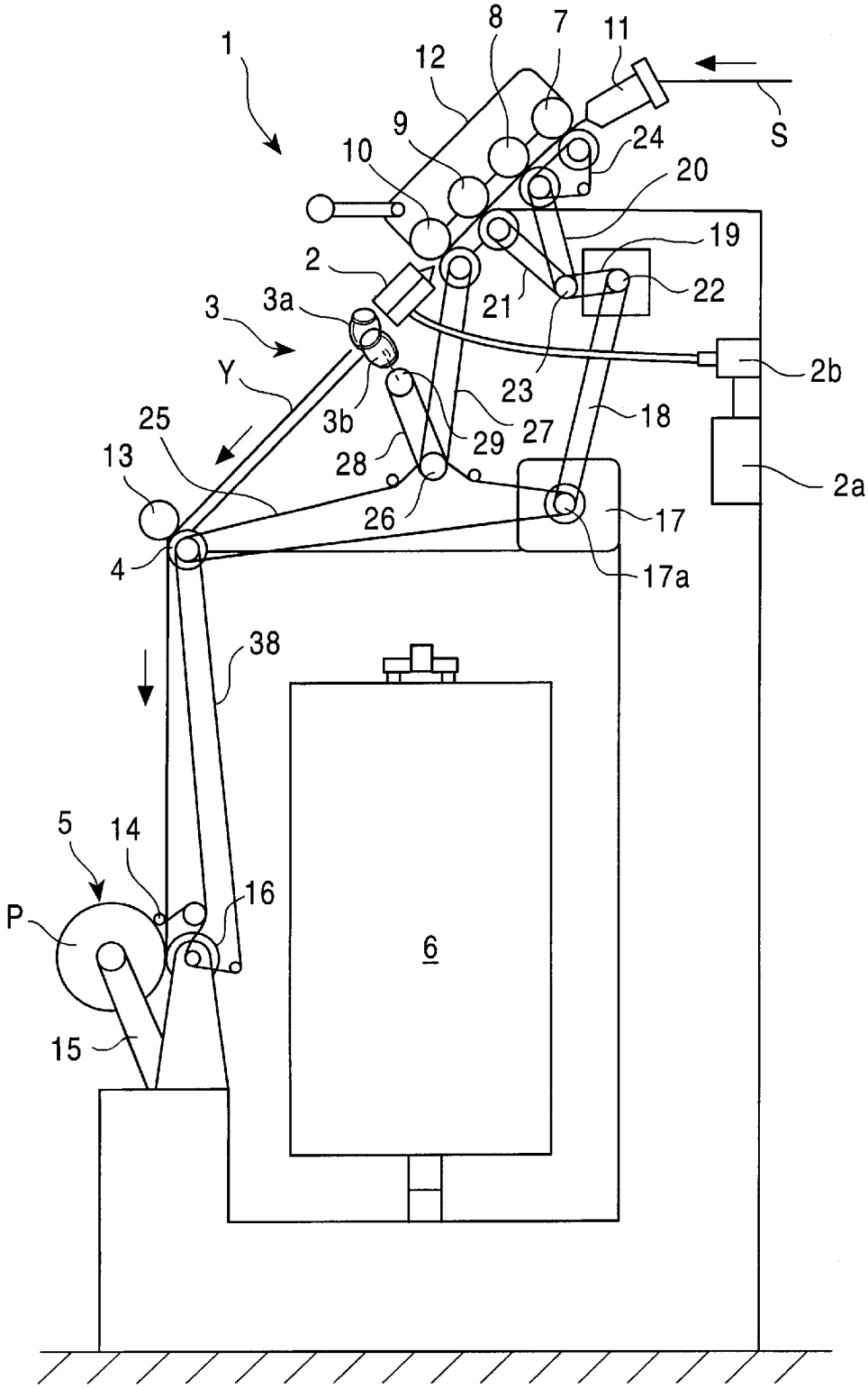
FIG. 1 is a side view of a spinning machine according to the present invention.

This spinning machine comprises a large number of spinning units disposed in parallel in the depth direction in FIG. 1. Each spinning unit includes a draft apparatus 1 for drafting a sliver S drawn out from a can, a spinning nozzle 2 that causes a fiber bundle exiting the draft apparatus 1 a circulate by the swirling air, a twisting apparatus 3 for twisting the fiber bundle exiting the spinning nozzle 2, in a direction reverse to that of the swirling air current (the spinning nozzle 2 and the twisting apparatus 3 being collectively referred to as "a spinning apparatus"), a delivery roller 4 that draws out yarn Y exiting the twisting apparatus 3; and a winding apparatus 5 for winding the yarn Y, which are sequentially arranged in the spinning machine. The delivery roller 4 and the winding apparatus 5 are sometimes collectively referred to as "a winding apparatus". The spinning machine has a self-travelling working carriage 6 which moves back and forth along each spinning unit in the longitudinal direction for piecing operation. The spinning speed of the spinning machine is 350 to 400 m/minute.

The draft apparatus 1 comprises four pairs of rollers; a pair of back rollers 7, a pair of third rollers 8, a pair of second rollers 9 having an apron belt 9*a* and a pair of front rollers 10. In addition, a trumpet guide 11 that introduces the sliver S between the pair of back rollers 7. Each top roller in the draft apparatus 1 is rotatably supported by a draft cradle 12 and is pressed by the respective bottom roller.

The spinning nozzle 2 is disposed on the downstream side of the pair of front rollers 10 and injects compressed air in a tangential and slightly downstream direction relative to the internal space in order to generate a swirling air current in a direction reverse to that of twisting effected by the twisting apparatus 3.

The spinning nozzle 2 has a valve 2*b* that supplies compressed air to each spinning unit separately. The valve 2*b* is configured so that the timings with which it is turned on and off are set by a control apparatus 2*a*. The valve 2*b* is set to stop the spinning nozzle 2 slightly later (about 0.1 second) than the twisting apparatus 3 when spinning stops, whereas the spinning nozzle 2 starts slightly earlier (about 0.1 second) than the twisting apparatus 3 when spinning starts. This is because unacceptable yarn having no wound fibers may be manufactured if the spinning nozzle 2 stops before the stop of spinning or starts after the start of spinning.

The twisting apparatus 3 comprises a pair of rollers 3*a* and 3*b* supported in such a way as to cross each other in the axial direction while remaining in contact with each other. Each roller 3*a* or 3*b* is a hollow roller in the form of a thin cylinder comprising an elastoplastic material, such as rubber, externally fitted on a core, and is shaped like a barrel swollen in the middle.

A nip roller 13 is pressed by the delivery roller 4 by means of a spring (not shown in the drawings). During piecing (connection between a fiber bundle and yarn), to allow yarn to be reliably fed when the yarn wound round a package is used as a leading yarn and is allowed to travel in the reverse direction, an operation is performed on the working carriage 6 side to cause the nip roller 13 to leave the delivery roller 4 against the force of the spring.

The winding apparatus 5 is rotatably supported by a cradle arm 15 while traversing the yarn Y using a traverse guide 14 and winds the yarn round a package P that rotates while being pressed by a friction roller 16.

Each of the above driving sections is driven by a motor 17 provided for each spinning unit, as shown in FIG. 1. The rotation of the motor 17 is transmitted from its rotating shaft 17*a*, through endless belts 18, 19, 20, and 21, via a decelerator 22 and a clutch 23, to the bottom roller of the third roller 8 and the bottom roller of the second roller 9. This rotation is transmitted to the bottom roller of the back roller 7 through the bottom roller of the third roller 8 via a belt 24. The rotation of the motor 17 is also transmitted to the delivery roller 4 and an intermediate shaft 26 by an endless belt 25. It is then transmitted from the intermediate shaft 26 via belts 27 and 28 to the bottom roller of the front roller 10 and a drive pulley 29 in the twisting apparatus 3, respectively.

Figure 2:
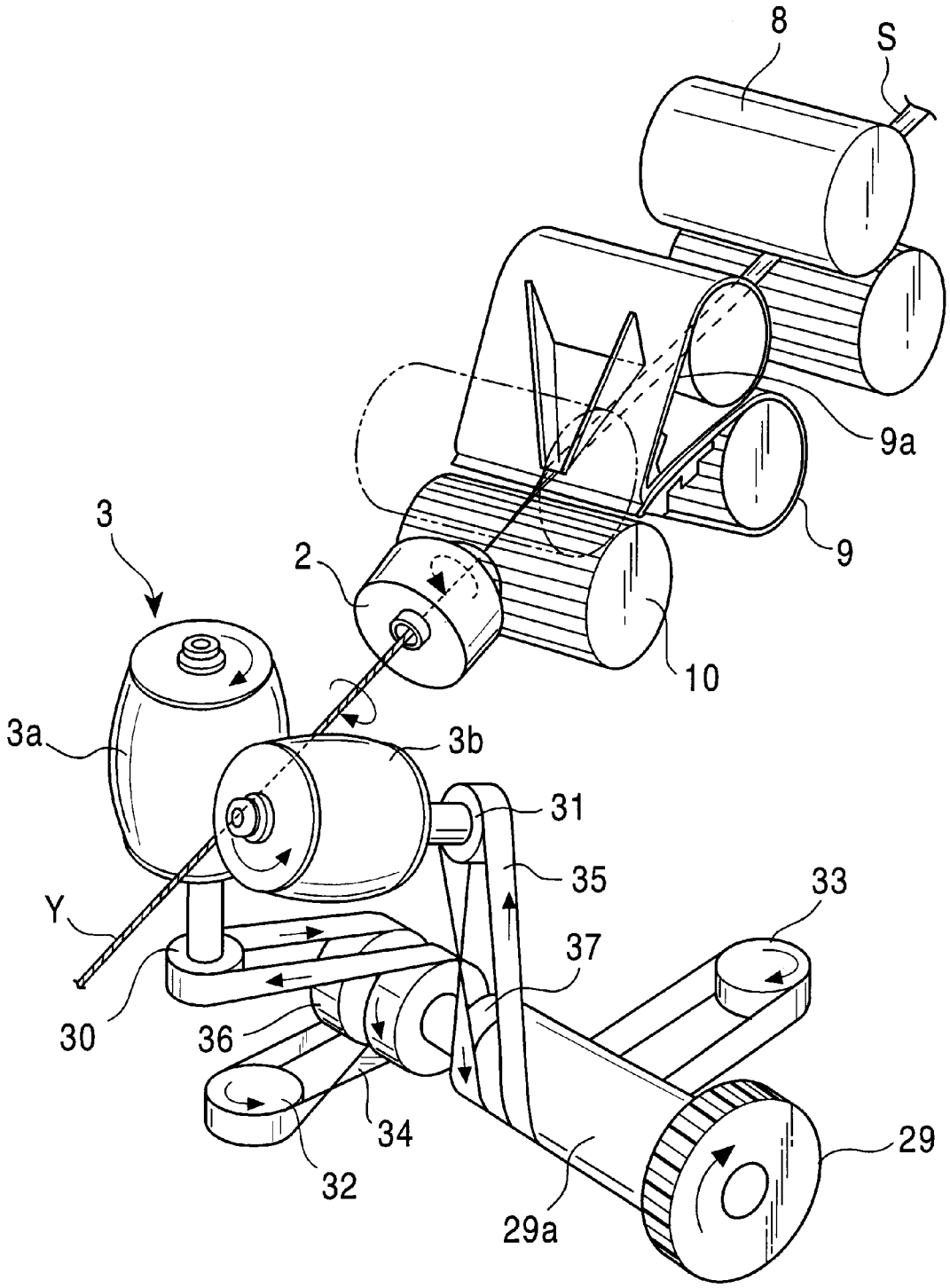
FIG. 2 is a perspective view of the main section of the spinning machine according to the present invention.

As shown in FIG. 2, endless belts 34 and 35 are passed via free-rotating rollers 32 and 33, respectively, between a shaft 29*a* of the drive pulley 29 and pulleys 30 and 31, which are fixed to the ends of rotating shafts of the rollers 3*a* and 3*b* constituting the twisting apparatus 3. Thus, the rollers 3*a* and 3*b* can synchronously rotate at equal peripheral speed. In FIG. 2, 36 and 37 are free-rotating rollers.

Returning to FIG. 1, the rotation of the delivery roller 4 is transmitted via a belt 38 to the friction roller 16, which rotates the package P and to a driving section of the traverse guide 14.

Since each spinning unit of this spinning machine is driven by one motor 17 as one driving section, the draft apparatus 1 can be decelerated and accelerated with the speed ratio of each pair of rollers being maintained, and when spinning stops, the draft apparatus 1, the twisting apparatus 3, the delivery roller 4 and the winding apparatus 5 simultaneously decelerate and stop. In this case, air injection from the spinning nozzle 2 stops slightly later than the twisting apparatus 3. In addition, when a spinning is activated, the draft apparatus 1, the twisting apparatus 3, the delivery roller 4 and the winding apparatus 5 are simultaneously accelerated and reach operating speeds. In this case, air injection from the spinning nozzle 2 starts slightly earlier than the twisting apparatus 3. In addition, the deceleration rate prior to the stop of the spinning is low, while the acceleration rate during the activation of the spinning is high. The deceleration or acceleration time is about five seconds.

The reason why the acceleration rate (the inclination of the line indicating the acceleration of the twisting apparatus 3 between times t2 and t3 in FIG. 3) during the activation of the spinning is high, while the deceleration rate (the inclination of the line indicating the deceleration of the twisting apparatus 3 between times t4 and t5 in FIG. 3) prior to the stopping of the spinning is low is explained below.

When the spinning stops, if the rotation due to inertia of the package continues after the driving of the friction roller 16 of the winding apparatus 5 has stopped, the yarn connected to the package may be stretched and cut when the rotation of the draft apparatus or spinning apparatus stops. Therefore, the deceleration rate should be low, considering the rotation due to inertia of the package. On the other hand, during activation, even if the rotation of the package starts slightly later, the yarn exiting the spinning apparatus may be slightly loosened but is prevented from being cut. Thus, the acceleration rate during activation may be higher than the deceleration rate prior to stop. If a package brake apparatus is provided in the cradle that supports the package, the deceleration rate need not necessarily be low. In the absence of such a brake apparatus, however, the deceleration rate must be reduced to prevent the yarn from being cut due to the package rotation inertia.

Figure 3:
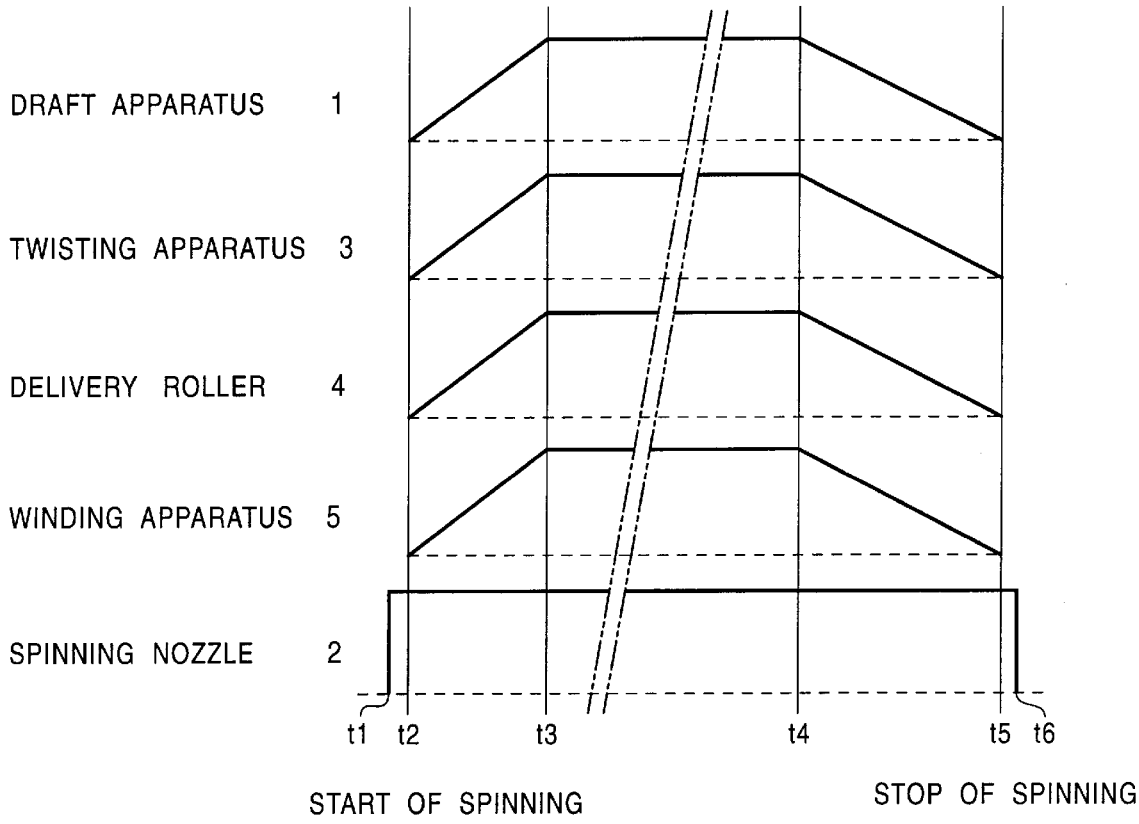
FIG. 3 is a timing chart showing an operation method according to the present invention.

FIG. 3 shows a timing chart for the above operation.

Prior to t1 when the spinning is activated (about 0.1 second before t1), the valve of the spinning nozzle 2 is turned on, and then the motor 17 starts driving, the draft apparatus 1, the twisting apparatus 3, the delivery roller 4 and the winding apparatus 5 accelerate at the same rate, and reach operating speeds at time t3. When an instruction for the stop of the spinning is issued at time t4, the draft apparatus 1, the twisting apparatus 3, the delivery roller 4 and the winding apparatus 5 decelerate at the same rate, and simultaneously stop at time t5. At t6, that is, 0.1 second later, air injection from the spinning nozzle 2 stops.

When such an operation is performed, a fiber bundle exiting the front roller 10 remains connected to the yarn Y extending from the winding package P through the delivery roller 4 and the twisting apparatus 3 to the spinning nozzle 2, and is prevented from being cut.

Thus, the above operation method enables the operator to easily perform a doffing operation using a spinning machine without an automatic doffing apparatus. In a normal spinning machine, a specified-length measuring control function is provided for each spinning unit so that when a winding package for a spinning unit becomes full, a fully-wound instruction is issued. In this case, the above operation method stops the draft apparatus 1, the twisting apparatus 3, the delivery roller 4, the winding apparatus 5 and the spinning nozzle 2 with the yarn remaining connected between the draft apparatus 1 and the winding apparatus 5. Thus, the operator manually rewinds the full package slightly and then cuts the yarn. Then, the operator removes the full package from the winding apparatus, winds round a new empty bobbin the yarn dangling from the delivery roller 13, and sets the empty bobbin, in the winding apparatus. Subsequently, a spinning activating switch is operated to enable the operation according to the above method to resume spinning without the need for piecing.

Due to the above configuration, the present invention has the following effects.

Upon the stop of spinning, a fiber bundle or yarn being spun is prevented from being cut. Thus, the conventional need to piece yarn each time the spinning is to be re-activated is eliminated in order to enable direct reactivation. The spinning can therefore be stopped and re-activated, as required, to facilitate maintenance and inspection. In addition, the spinning is stopped and re-activated through a gradual acceleration to prevent loads from being rapidly applied in order to prevent each section of the spinning unit from being damaged, thereby increasing the life expectancy of the spinning unit and enabling the stoppage and re-activation to be executed silently. Furthermore, upon the stopping of the spinning, the winding package is prevented from overrunning by being stopped slowly through deceleration, thereby minimizing the likelihood of the yarn being cut.

We claim:

1. A spinning machine comprising multiple spinning units each having a draft apparatus, a spinning apparatus for spinning a fiber bundle exiting the draft apparatus and a winding apparatus for winding yarn spun by the spinning apparatus characterized in that the draft apparatus, spinning apparatus and winding apparatus for each spinning unit is driven by a single motor provided each spinning unit.

2. A spinning machine according to claim 1 characterized in that said spinning apparatus comprises a spinning nozzle that injects a swirling air current and a twisting apparatus for twisting spun yarn in a direction reverse to that of said swirling air current.

3. A method for operating a spinning machine comprising a plurality of spinning units, each having a draft apparatus, a spinning apparatus for spinning a fiber bundle exiting the draft apparatus and a winding apparatus for winding yarn spun by the spinning apparatus, comprising the steps of:

driving each spinning unit independently, and when the spinning is to be stopped, simultaneously stopping said draft apparatus, said spinning apparatus and said winding apparatus by synchronously decelerating said draft apparatus, said spinning apparatus and said winding apparatus, and when the spinning is to be activated, simultaneously activating said draft apparatus, said spinning apparatus and said winding apparatus by synchronously accelerating said draft apparatus, said spinning apparatus and said winding apparatus.

4. The method according to claim 3 wherein each said spinning unit includes a twisting apparatus, including the steps of spinning said fiber bundle by injecting air through a spinning nozzle to generate a swirling air current, and twisting yarn spun in said spinning apparatus by said twisting apparatus in a direction reverse that of said swirling air current.

5. The method according to claim 4 including the steps of stopping air injection to each spinning nozzle when the spinning of said fiber bundle is to be stopped and starting air injection to each spinning nozzle when the spinning of said fiber bundle is to be started.

6. The method according to claim 5 including the steps of:

stopping the air injection from the spinning nozzle later than the stopping of said twisting apparatus when spinning of said fiber bundle stops, and starting the air injection from the spinning nozzle prior to activation of said twisting apparatus when spinning of said fiber bundle is activated.

7. The method according to any one of claims 3 to 6 including the steps of:

maintaining the rate of deceleration of said draft apparatus, said spinning apparatus and said winding apparatus low when spinning is to be stopped, and maintaining the rate of acceleration of said draft apparatus, said spinning apparatus and said winding apparatus high when spinning is to be activated.

* * * * *